US008894276B2

(12) United States Patent
Tedeschi

(10) Patent No.: US 8,894,276 B2
(45) Date of Patent: Nov. 25, 2014

(54) CLOCK MOVEMENT

(75) Inventor: Marco Tedeschi, Le Vaud (CH)

(73) Assignee: Hublot SA. Geneve, Geneva (CH)

( * ) Notice: Subject to any disclaimer, the term of this patent is extended or adjusted under 35 U.S.C. 154(b) by 146 days.

(21) Appl. No.: 13/256,059

(22) PCT Filed: Mar. 22, 2010

(86) PCT No.: PCT/CH2010/000079

§ 371 (c)(1),
(2), (4) Date: Dec. 5, 2011

(87) PCT Pub. No.: WO2010/108293

PCT Pub. Date: Sep. 3, 2010

(65) Prior Publication Data

US 2012/0092969 A1 Apr. 19, 2012

(30) Foreign Application Priority Data

Mar. 25, 2009 (CH) ..... 0464/09

(51) Int. Cl.

| | |
|---|---|
| ***G04B 15/00*** | (2006.01) |
| ***G04B 29/02*** | (2006.01) |
| ***G04B 33/10*** | (2006.01) |
| ***G04B 33/00*** | (2006.01) |

(52) U.S. Cl.

CPC ..... *G04B 33/10* (2013.01); *G04B 29/02* (2013.01); *G04B 33/00* (2013.01)

USPC ..... 368/318; 368/127

(58) Field of Classification Search

USPC ..... 368/124–138, 139–154, 220–222, 318

See application file for complete search history.

(56) References Cited

U.S. PATENT DOCUMENTS

| | | | | |
|---|---|---|---|---|
| 2,167,604 | A * | 7/1939 | Thiebaud | 368/76 |
| 2,192,272 | A * | 3/1940 | Puthod | 368/76 |
| 2,229,428 | A * | 1/1941 | Thiebaud | 368/324 |
| 2,872,775 | A * | 2/1959 | Maire | 368/220 |

(Continued)

FOREIGN PATENT DOCUMENTS

| | | | |
|---|---|---|---|
| CH | 007731 | A | 6/1894 |
| CH | 323377 | A | 7/1957 |

(Continued)

OTHER PUBLICATIONS

Machine Translation of CH441474 from Espacenet.*

(Continued)

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

The invention relates to a clock movement including a frame (6) having a barrel (1) that contains a mainspring, a finishing gear train (2-4), an escapement mechanism (5, 7), and a spiral balance spring (8). The frame (6) comprises first clamp bodies (25, 24) for receiving respective pivotal movement members of the escapement wheel (5) and of the anchor (7), and second homologous clamp bodies (22, 26) alternating with the first clamp bodies (25, 24), the first and second clamp bodies (25, 22) of the escapement wheel being located on a circle centered on the axis of the mean wheel (3) of the finishing gear train and defining a plane that is orthogonal to said axis.

20 Claims, 3 Drawing Sheets

(56) References Cited

U.S. PATENT DOCUMENTS

| | | | | |
|---|---|---|---|---|
| 3,138,916 | A * | 6/1964 | Beaumann | 368/142 |
| 3,968,642 | A * | 7/1976 | Burki | 368/318 |
| 2010/0290321 | A1 * | 11/2010 | Martinez et al. | 368/220 |
| 2011/0038233 | A1 * | 2/2011 | Martinez et al. | 368/127 |

FOREIGN PATENT DOCUMENTS

| | | | | |
|---|---|---|---|---|
| CH | 376061 | A | 11/1963 | |
| CH | 441474 | * | 12/1975 | G04B 33/02 |
| CH | 577203 | B5 | 6/1976 | |
| DE | 1900181 | U | 9/1964 | |
| EP | 1102135 | A1 | 5/2001 | |
| FR | 1177145 | A | 4/1959 | |
| FR | 1366560 | A | 7/1964 | |

OTHER PUBLICATIONS

International Search Report in PCT/CH2010/000079, date of mailing Sep. 3, 2010.

* cited by examiner

CLOCK MOVEMENT

The present invention relates to a clockwork movement comprising a frame supporting a barrel containing a mainspring, a finishing gear train, an escapement mechanism and a spiral-balance.

A clockwork movement is capable of receiving various "complications", a name given by clockmakers to all the additional mechanisms designed to indicate time intervals other than the hours, the minutes and the seconds. These mechanisms often consist of additional modules that are fitted to the clockwork movement and are connected to it by one of its mobiles of the finishing gear train or of the motion-work gear train.

In some cases, the presence of a seconds hand and therefore of a seconds wheel at the center may form an obstacle to the additional mechanism with which it is desired to furnish the clockwork movement. In other cases, the seconds wheel at the center of the clockwork movement is not an obstacle and is desired. The drawback arises from the fact that it is necessary to have two different clockwork movements to respond to these requirements. Two different clockwork movements involve two distinct production lines.

The object of the present invention is to make it possible, from one and the same clockwork movement, to have a seconds wheel at the center and a seconds wheel off-centered.

Accordingly, the subject of the present invention is a clockwork movement as claimed in claim 1.

The advantage of such a movement is that it allows a more advanced rationalization of production on the basis of one and the same movement, while nowadays it is necessary to change movement depending on the type of complication with which it is desired to fit the timepiece. It is obvious that making it possible to fit one and the same movement with the largest possible number of complications substantially simplifies production planning.

The appended drawings illustrate schematically and as an example, one form of execution of the clockwork movement that is the subject of the present invention.

Figure 1:
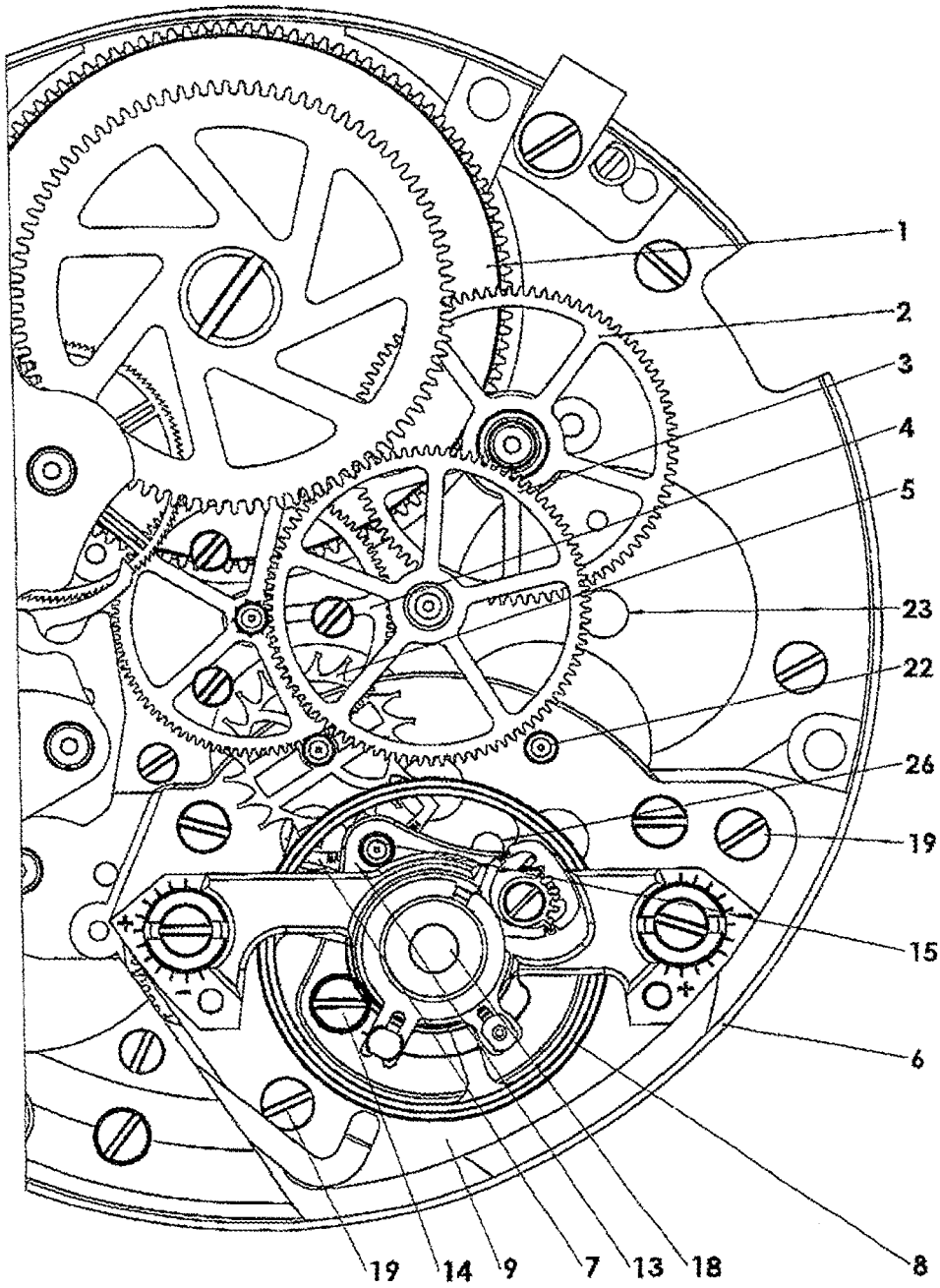
FIG. 1 is a plan view of the clockwork movement in its version with the seconds hand at the center.

FIG. 1 illustrates a clockwork movement of a watch comprising essentially a mainspring housed in a barrel 1, the tooth gear of which meshes with the pinion of the minutes wheel 2 which is not situated at the center of the movement. This minutes wheel meshes with the pinion of the third wheel 3 which meshes with the pinion of the seconds wheel 4, the spindle of which coincides with the central spindle of the clockwork movement. This seconds wheel meshes with the pinion of the escapement wheel 5.

Since the minutes wheel 2 is not situated at the center of the clockwork movement, the third wheel 3 supports a second pinion (not shown) on the side of the movement turned toward the face and meshes with a minutes wheel which is situated at the center of the movement and which supports the cannon-pinion (not shown). These elements are known to those skilled in the art and are not necessary to the understanding of the present invention.

The finishing gear train that has just been described is supported, as usually between bearings secured to a plate 6 and bearings secured to bridges fixed to the plate 6. These bridges have been removed to make it possible to see the finishing gear train.

Figure 2:
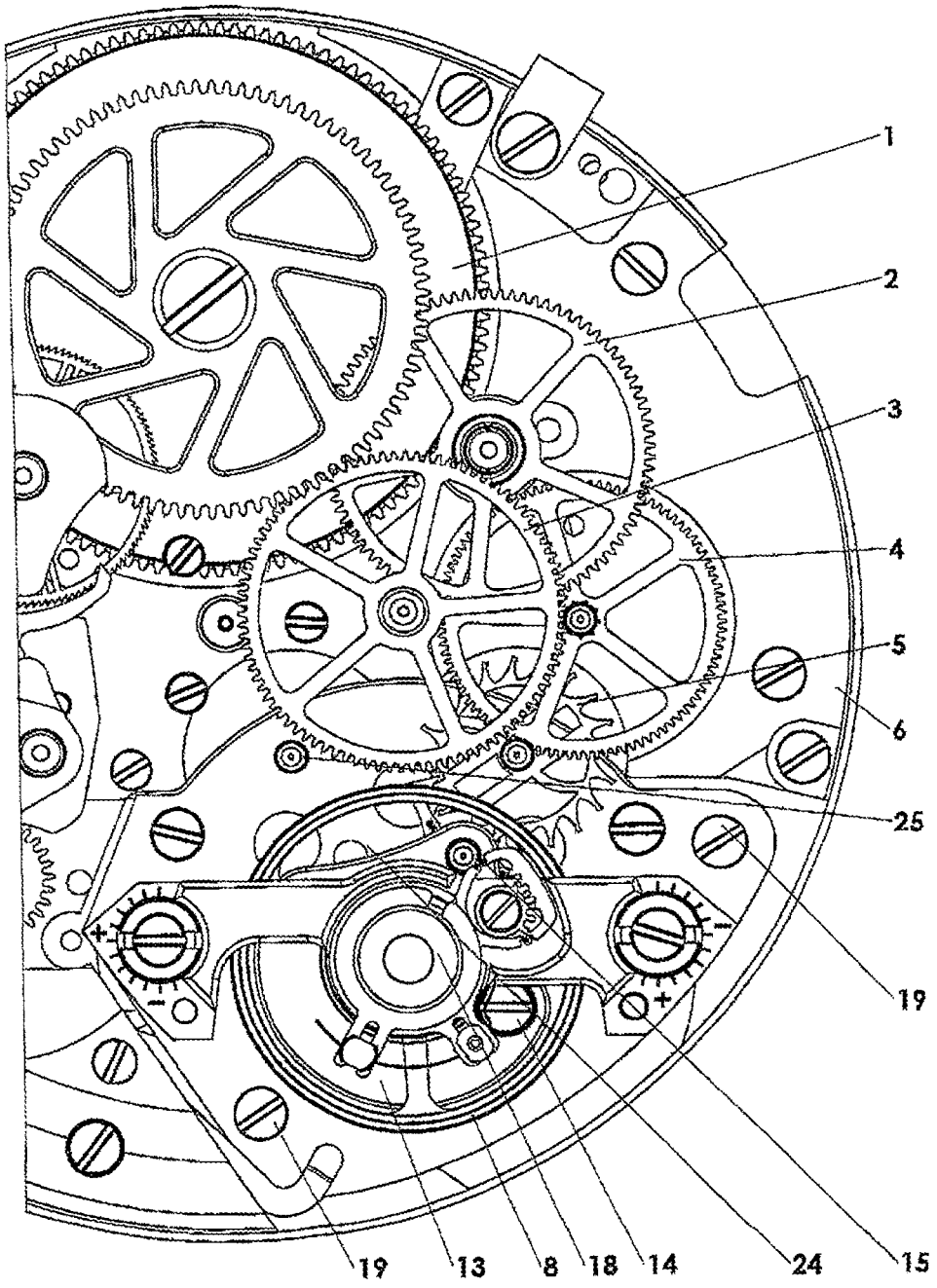
FIG. 2 is a plan view of this same clockwork movement in its version with the seconds hand off-centered.
Figure 3:
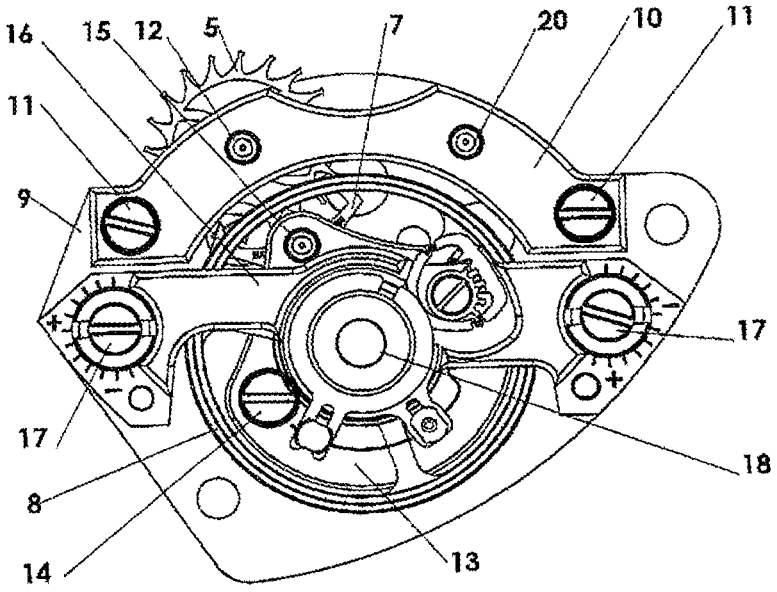
FIG. 3 is a partial plan view of the clockwork movement according to FIG. 1 and representing the whole of the escapement and of the regulating system.

As illustrated in particular by FIG. 3, the whole of the escapement and of the regulating system comprising the escapement wheel 5, a pallets 7 and a spiral-balance 8 is placed on an auxiliary frame 9. An escapement bridge 10 fixed to the auxiliary frame 9 by two screws 11 comprises a first bearing 12 for the pivoting of the top end of the spindle of the escapement wheel 5. A pallets bridge 13 is fixed by two screws 14, only one of which can be seen in FIG. 1, while the other can be seen in FIG. 2. This pallets bridge comprises a bearing 15 for the pivoting of the top end of the spindle of the pallets 7. Finally, a balance bridge 16 is fixed by two screws 17 to the auxiliary frame 9. This balance bridge 16 comprises a bearing 18 for the pivoting of the top end of the spiral-balance spindle 8. The auxiliary frame 9 is fixed to the plate 6 by two screws 19 and is positioned by feet (not shown) like bridges.

As can be ascertained in FIG. 3, the escapement bridge 10 comprises a second bearing 20 symmetrical with the first bearing 12 relative to an axis of symmetry connecting the spindles of the spiral-balance 8 to that of the third wheel 3. In FIGS. 1 and 3, this second bearing 20 is not used. The auxiliary plate 9 comprises an aperture 22 coaxial with the bearing 20 and forming the seat of a second bearing coaxial with the bearing 20 for the spindle of the escapement wheel 5.

With reference now to FIG. 2, it can be seen that the escapement wheel 5 is now pivoted in the second bearing of the escapement bridge 10. The pinion of the escapement wheel 5 meshes with the seconds wheel 4 which is then off-center relative to the center of the clockwork movement. Its pinion meshes with the third wheel 3 which remains in the same place as in FIG. 1.

FIG. 1 shows apertures 26 and 23 made respectively in the auxiliary frame 9 and in the plate 6, forming seats to receive the bottom bearings of the respective pivoting spindles of the escapement pallets 7 and of the seconds wheel 4, in the version with off-centered seconds wheel illustrated by FIG. 2.

Moreover FIG. 2 shows apertures 24 and 25 made in the auxiliary frame 9, respectively forming the seats to receive the bottom bearings of the respective pivoting spindles of the pallets 7 and of the escapement wheel 5, in the version with centered seconds wheel illustrated by FIG. 1.

The pallets bridge 13 is moved angularly about the pivoting spindle of the spiral-balance 8 and the auxiliary frame 9 comprises means for the positioning and the fixing of the pallets bridge 13 by the screws 14 in the two positions, that of FIG. 1 and that of FIG. 2.

As can be seen, FIGS. 1 and 2 correspond respectively to the versions of the clockwork movement with seconds wheel at the center, therefore with seconds hand at the center and with seconds hand off-centered, based on a clockwork movement comprising the same components. Specifically, there is no part that is different and no extra or missing parts between the two versions of this movement, including with respect to the auxiliary frame 9; only the position of the pallets 7, of the escapement wheel 5 and of the seconds wheel 4 changes. On the other hand neither the structure nor the number of parts changes.

Moreover, the auxiliary frame 9 makes it possible to carry out the installation of this auxiliary frame 9 according to the version for seconds wheel at the center or according to the version for seconds wheel off-centered. It is then sufficient to install the version of this module preassembled with the escapement wheel 5 pivoted in the bearings or bearing seats 12, 25 and the pallets 7 in the bearings or bearing seats 15, 24 on a plate 6 with seconds wheel at the center or to install the version of this module preassembled with the escapement wheel 5 pivoted in the bearings or bearing seats 20, 22 and the pallets 7 in the bearings or bearing seats 15, 26 on a plate 6 with seconds wheel 4 off-centered.

The total identity of all the components of the two versions of the clockwork movement is also an advantage for after-sales service, because all the parts can be used without distinction in both versions, which simplifies their replacement by removing the risk of errors.

The invention claimed is:

1. A clockwork movement comprising:

a frame supporting a barrel containing a mainspring, a finishing gear train including a seconds wheel, an escapement mechanism including an escapement wheel, and a spiral-balance, wherein the frame comprises:

first seats for receiving respective pivoting members of the seconds wheel at the center, and of the escapement wheel, and second seats which are equivalents and alternatives of the first seats with seconds wheel off-centered, wherein the respective first seats for receiving the respective pivoting members of the seconds wheel and of the escapement wheel are different from the respective second seats for receiving the respective pivoting members of the seconds wheel and of the escapement wheel, the pivoting members of the seconds wheel and of the escapement wheel being received in either (i) the first seats for receiving the respective pivoting members of the seconds wheel and of the escapement wheel or (ii) the second seats for receiving the respective pivoting members of the seconds wheel and of the escapement wheel.

2. The clockwork movement as claimed in claim 1, wherein the escapement mechanism and the spiral-balance are mounted on an auxiliary frame fixed and positioned on the frame which supports the rest of the movement.

3. The clockwork movement as claimed in claim 1, wherein the frame further comprises a first seat and a second seat for receiving a pivoting member of a pallets of the escapement mechanism, wherein the first seat for receiving the pivoting member of the pallets is different from the second seat for receiving the pivoting member of the pallets, the pivoting member of the pallets being received in either (i) the first seat for receiving the respective pivoting members of the seconds wheel and of the escapement wheel, or (ii) the second seat for receiving the respective pivoting members of the seconds wheel and of the escapement wheel.

4. The clockwork movement as claimed in claim 3, wherein the frame comprises a first bearing forming the first seat for receiving the pivoting member of the escapement wheel and a second bearing forming the second seat for receiving the pivoting member of the escapement wheel.

5. The clockwork movement as claimed in claim 4, wherein the frame comprises a bearing which can be positioned in a first position forming the first seat for receiving the pivoting member of the pallets and in a second position forming the second seat for receiving the pivoting member of the pallets.

6. The clockwork movement as claimed in claim 5, wherein the bearing for forming the first and second seats for receiving the pivoting member of the pallets is provided on a pallets bridge which can be positioned and fixed in two positions on an auxiliary frame fixed and positioned on the frame.

7. The clockwork movement as claimed in claim 6, wherein the second position of the pallets bridge is moved angularly about the pivoting spindle of the spiral-balance.

8. The clockwork movement as claimed in claim 6, wherein the pallets bridge can be fixed to the frame by screws in each of the respective positions.

9. The clockwork movement as claimed in claim 3, wherein the frame comprises a bearing which can be positioned in a first position forming the first seat for receiving the pivoting member of the pallets and in a second position forming the second seat for receiving the pivoting member of the pallets.

10. The clockwork movement as claimed in claim 9, wherein the first and second bearings forming the first and second seats for receiving the pivoting member of the escapement wheel are provided on an escapement bridge fixed and positioned on an auxiliary frame fixed and positioned on the frame which supports the rest of the movement.

11. The clockwork movement as claimed in claim 10, wherein the frame comprises a bearing which can be positioned in a first position forming the first seat for receiving the pivoting member of the pallets and in a second position forming the second seat for receiving the pivoting member of the pallets.

12. The clockwork movement as claimed in claim 11, wherein the bearing for forming the first and second seats for receiving the pivoting member of the pallets is provided on a pallets bridge which can be positioned and fixed in two positions on an auxiliary frame fixed and positioned on the frame.

13. The clockwork movement as claimed in claim 12, wherein the second position of the pallets bridge is moved angularly about the pivoting spindle of the spiral-balance.

14. The clockwork movement as claimed in claim 10, wherein the escapement bridge is fixed to the frame by screws.

15. The clockwork movement as claimed in claim 9, wherein the bearing for forming the first and second seats for receiving the pivoting member of the pallets is provided on a pallets bridge which can be positioned and fixed in two positions on an auxiliary frame fixed and positioned on the frame.

16. The clockwork movement as claimed in claim 15, wherein the second position of the pallets bridge is moved angularly about the pivoting spindle of the spiral-balance.

17. The clockwork movement as claimed in claim 15, wherein the pallets bridge can be fixed to the frame by screws in each of the respective positions.

18. The clockwork movement as claimed in claim 1, wherein the frame comprises a first bearing forming the first seat for receiving the pivoting member of the escapement wheel and a second bearing forming the second seat for receiving the pivoting member of the escapement wheel.

19. The clockwork movement as claimed in claim 18, wherein the first and second bearings forming the first and second seats for receiving the pivoting member of the escapement wheel are provided on an escapement bridge fixed and positioned on an auxiliary frame fixed and positioned on the frame which supports the rest of the movement.

20. The clockwork movement as claimed in claim 19, wherein the escapement bridge is fixed to the frame by screws.

* * * * *